US008251258B2

(12) United States Patent
Rudick et al.

(10) Patent No.: US 8,251,258 B2
(45) Date of Patent: Aug. 28, 2012

(54) SYSTEMS AND METHODS OF SELECTING AND DISPENSING PRODUCTS

(75) Inventors: Arthur G Rudick, Atlanta, GA (US); Annie T Ellis, Locust Grove, GA (US)

(73) Assignee: The Coca-Cola Company, Atlanta, GA (US)

( * ) Notice: Subject to any disclaimer, the term of this patent is extended or adjusted under 35 U.S.C. 154(b) by 1028 days.

(21) Appl. No.: 12/204,208

(22) Filed: Sep. 4, 2008

(65) Prior Publication Data

US 2009/0069933 A1 Mar. 12, 2009

Related U.S. Application Data

(60) Provisional application No. 60/970,359, filed on Sep. 6, 2007.

(51) Int. Cl.
*B67D 7/22* (2010.01)

(52) U.S. Cl. ..... 222/31; 222/1; 222/49; 222/59; 222/129.1

(58) Field of Classification Search ..... 222/31, 222/49, 59, 129.1, 1
See application file for complete search history.

(56) References Cited

U.S. PATENT DOCUMENTS

| | | | |
|---|---|---|---|
| 4,487,333 | A | 12/1984 | Pounder et al. |
| 4,517,651 | A | 5/1985 | Kawasaki et al. |
| 4,563,739 | A | 1/1986 | Gerpheide et al. |
| 4,753,370 | A | 6/1988 | Rudick |
| 4,779,761 | A | 10/1988 | Rudick et al. |
| 4,793,520 | A | 12/1988 | Gerber |
| 4,819,176 | A | 4/1989 | Ahmed et al. |
| 4,821,925 | A | 4/1989 | Wiley et al. |
| 4,827,426 | A | 5/1989 | Patton et al. |
| 4,830,511 | A | 5/1989 | Smazik |
| 4,860,923 | A | 8/1989 | Kirschner et al. |
| 4,881,663 | A | 11/1989 | Seymour |
| 4,889,148 | A | 12/1989 | Smazik |
| 4,923,093 | A | 5/1990 | Gerber |
| 4,934,567 | A | 6/1990 | Vahjen et al. |
| 4,955,507 | A | 9/1990 | Kirschner et al. |
| 5,147,068 | A | 9/1992 | Wright |
| 5,154,586 | A | 10/1992 | Rudick |
| 5,255,819 | A | 10/1993 | Peckels |

(Continued)

FOREIGN PATENT DOCUMENTS

| | | |
|---|---|---|
| AT | 319795 | 1/1975 |

(Continued)

OTHER PUBLICATIONS

International Search Report and Written Opinion for PCT/US2009/035410 dated Apr. 14, 2009.

(Continued)

*Primary Examiner* — Kevin P Shaver
*Assistant Examiner* — Melvin Cartagena
(74) *Attorney, Agent, or Firm* — Sutherland Asbill & Brennan LLP

(57) ABSTRACT

Embodiments of a dispensing system for dispensing a number of products to a user are disclosed. The dispensing system may include an input/output device and a dispenser. The input/output device may be adapted to receive a selection of one of the products from the user. The dispenser may be adapted to dispense a plurality of diluent components, the diluent components and a ratio of the diluent components corresponding at least in part to the selection of the user.

16 Claims, 7 Drawing Sheets

U.S. PATENT DOCUMENTS

| | | | |
|---|---|---|---|
| 5,292,030 | A | 3/1994 | Kateman et al. |
| 5,312,017 | A | 5/1994 | Schroeder et al. |
| 5,341,957 | A | 8/1994 | Sizemore |
| 5,358,145 | A | 10/1994 | Smith et al. |
| 5,433,967 | A | 7/1995 | Kateman et al. |
| 5,465,870 | A | 11/1995 | Sizemore |
| 5,473,909 | A | 12/1995 | Kateman et al. |
| 5,507,415 | A | 4/1996 | Sizemore |
| 5,575,405 | A | 11/1996 | Stratton et al. |
| 5,588,557 | A | 12/1996 | Topar |
| 5,603,257 | A | 2/1997 | Kateman et al. |
| 5,603,430 | A | 2/1997 | Loehrke et al. |
| 5,615,801 | A | 4/1997 | Schroeder et al. |
| 5,691,684 | A | 11/1997 | Murrah |
| 5,704,350 | A | 1/1998 | Williams, III |
| 5,725,125 | A | 3/1998 | Bessette et al. |
| 5,727,713 | A | 3/1998 | Kateman et al. |
| 5,735,436 | A | 4/1998 | Schroeder et al. |
| 5,758,571 | A | 6/1998 | Kateman et al. |
| 5,778,761 | A | 7/1998 | Miller |
| 5,798,694 | A | 8/1998 | Reber et al. |
| 5,803,320 | A | 9/1998 | Cutting et al. |
| 5,842,603 | A | 12/1998 | Schroeder et al. |
| 5,868,065 | A | 2/1999 | Haggerty et al. |
| 5,878,964 | A | 3/1999 | Hansen |
| 5,890,626 | A | 4/1999 | Wolski et al. |
| 5,960,997 | A | 10/1999 | Forsythe |
| 5,975,365 | A | 11/1999 | Hsieh |
| 5,980,969 | A | 11/1999 | Mordini et al. |
| 6,119,434 | A | 9/2000 | Andersson |
| 6,126,983 | A | 10/2000 | Miller |
| 6,131,399 | A | 10/2000 | Hall |
| 6,152,591 | A | 11/2000 | McCall et al. |
| 6,170,707 | B1 | 1/2001 | Wolski et al. |
| 6,173,862 | B1 | 1/2001 | Buca et al. |
| 6,186,193 | B1 | 2/2001 | Phallen et al. |
| 6,238,721 | B1 | 5/2001 | Knepler |
| 6,350,484 | B1 | 2/2002 | Ault |
| 6,354,468 | B1 | 3/2002 | Riek |
| 6,378,275 | B1 | 4/2002 | Andersson |
| 6,421,583 | B1 | 7/2002 | Sudolcan et al. |
| 6,424,884 | B1 | 7/2002 | Brooke et al. |
| 6,435,375 | B2 | 8/2002 | Durham et al. |
| 6,446,834 | B2 | 9/2002 | Davis et al. |
| 6,465,035 | B1 | 10/2002 | Knepler |
| 6,479,086 | B1 | 11/2002 | Knepler |
| 6,496,752 | B2 | 12/2002 | Sudolcan et al. |
| 6,536,626 | B2 | 3/2003 | Newman et al. |
| 6,550,641 | B2 | 4/2003 | Newman et al. |
| 6,550,642 | B2 | 4/2003 | Newman et al. |
| 6,564,999 | B1 | 5/2003 | Saveliev et al. |
| 6,572,016 | B2 | 6/2003 | Saveliev et al. |
| 6,588,725 | B1 | 7/2003 | Wisnieski et al. |
| 6,600,968 | B2 | 7/2003 | Sudolcan et al. |
| 6,600,969 | B2 | 7/2003 | Sudolcan et al. |
| 6,650,962 | B2 | 11/2003 | Sudolcan et al. |
| 6,669,053 | B1 | 12/2003 | Garson et al. |
| 6,689,410 | B2 | 2/2004 | Gerber |
| 6,694,748 | B2 | 2/2004 | Sergio et al. |
| 6,698,228 | B2 | 3/2004 | Kateman et al. |
| 6,726,062 | B2 | 4/2004 | Segiet |
| 6,745,595 | B1 | 6/2004 | Kateman et al. |
| 6,751,525 | B1 | 6/2004 | Crisp |
| 6,756,069 | B2 | 6/2004 | Scoville et al. |
| 6,759,072 | B1 | 7/2004 | Gutwein |
| 6,763,860 | B2 | 7/2004 | Jungmann et al. |
| 6,766,656 | B1 | 7/2004 | Crisp, III et al. |
| 6,772,944 | B2 | 8/2004 | Brown |
| 6,799,085 | B1 | 9/2004 | Crisp |
| 6,807,460 | B2 | 10/2004 | Black et al. |
| 6,907,741 | B2 | 6/2005 | Kateman |
| 6,918,258 | B2 | 7/2005 | Cunha et al. |
| 6,934,602 | B2 | 8/2005 | Sudolcan et al. |
| 6,941,858 | B2 | 9/2005 | Kateman |
| 6,952,928 | B2 | 10/2005 | Kateman et al. |
| 6,957,125 | B1 | 10/2005 | Rifkin |
| 6,968,876 | B2 | 11/2005 | Yacko et al. |
| 6,973,478 | B1 | 12/2005 | Ketonen et al. |
| 6,980,887 | B2 | 12/2005 | Varga et al. |
| 6,982,640 | B2 | 1/2006 | Lindsay et al. |
| 6,983,863 | B2 | 1/2006 | Santy, Jr. |
| 6,990,391 | B1 | 1/2006 | Cunha et al. |
| 6,994,231 | B2 | 2/2006 | Jones |
| 7,009,519 | B2 | 3/2006 | Leonard et al. |
| 7,020,680 | B2 | 3/2006 | Defosse |
| 7,028,861 | B2 | 4/2006 | Sayers et al. |
| 7,031,804 | B2 | 4/2006 | Brooke et al. |
| 7,032,818 | B2 | 4/2006 | Thomas |
| 7,053,773 | B2 | 5/2006 | McGarry et al. |
| 7,077,290 | B2 | 7/2006 | Bethuy et al. |
| 7,082,970 | B2 | 8/2006 | Bartholomew et al. |
| 7,108,024 | B2 | 9/2006 | Navarro |
| 7,108,156 | B2 | 9/2006 | Fox |
| 7,147,131 | B2 | 12/2006 | Sher et al. |
| 7,156,115 | B2 | 1/2007 | Everett et al. |
| 7,156,259 | B2 | 1/2007 | Bethuy et al. |
| 7,159,743 | B2 | 1/2007 | Brandt et al. |
| 7,162,391 | B2 | 1/2007 | Kneiler et al. |
| 7,164,966 | B2 | 1/2007 | Sudoican |
| 7,168,593 | B2 | 1/2007 | Schroeder et al. |
| 7,203,572 | B2 | 4/2007 | Crisp, III |
| 7,223,427 | B2 | 5/2007 | Knepler |
| 7,243,818 | B2 | 7/2007 | Jones |
| 7,320,416 | B2 | 1/2008 | Miller et al. |
| 7,325,485 | B2 | 2/2008 | Carhuff et al. |
| 7,331,483 | B2 | 2/2008 | Bhimani et al. |
| 7,347,334 | B2 | 3/2008 | Thorn et al. |
| 7,353,080 | B2 | 4/2008 | Walker et al. |
| 7,387,239 | B2 | 6/2008 | Thomas et al. |
| 7,391,318 | B2 | 6/2008 | Higashi |
| 7,578,415 | B2 | 8/2009 | Ziesel |
| 7,584,657 | B2 | 9/2009 | Heller et al. |
| 7,640,755 | B1 | 1/2010 | Kateman |
| 2002/0023935 | A1 * | 2/2002 | Heyes ..... 222/129.1 |
| 2002/0059175 | A1 | 5/2002 | Nakano |
| 2002/0077889 | A1 | 6/2002 | Kolls |
| 2002/0123926 | A1 | 9/2002 | Bushold et al. |
| 2002/0143626 | A1 | 10/2002 | Voltmer et al. |
| 2002/0161653 | A1 | 10/2002 | Walker et al. |
| 2002/0183893 | A1 | 12/2002 | Brooke et al. |
| 2003/0010791 | A1 | 1/2003 | Gentiluomo et al. |
| 2003/0012864 | A1 | 1/2003 | Gerber |
| 2003/0032474 | A1 | 2/2003 | Kaminkow |
| 2003/0097314 | A1 | 5/2003 | Crisp, II et al. |
| 2003/0129286 | A1 | 7/2003 | Knepler |
| 2003/0191709 | A1 | 10/2003 | Elston et al. |
| 2003/0216964 | A1 | 11/2003 | MacLean et al. |
| 2003/0227820 | A1 | 12/2003 | Parrent |
| 2004/0026447 | A1 | 2/2004 | Badin et al. |
| 2004/0026451 | A1 | 2/2004 | Jones |
| 2004/0026452 | A1 | 2/2004 | Santiago et al. |
| 2004/0040983 | A1 | 3/2004 | Ziesel |
| 2004/0071841 | A1 | 4/2004 | Carhuff et al. |
| 2004/0103033 | A1 | 5/2004 | Reade et al. |
| 2004/0113786 | A1 | 6/2004 | Maloney |
| 2004/0129720 | A1 | 7/2004 | Cheng et al. |
| 2004/0170727 | A1 | 9/2004 | Howard et al. |
| 2004/0217129 | A1 | 11/2004 | Roekens et al. |
| 2004/0226994 | A1 | 11/2004 | Brown |
| 2004/0243259 | A1 | 12/2004 | Peterson et al. |
| 2004/0254837 | A1 | 12/2004 | Roshkoff |
| 2005/0029287 | A1 | 2/2005 | Mobbs |
| 2005/0055874 | A1 | 3/2005 | Bekemeyer |
| 2005/0075900 | A1 | 4/2005 | Arguimbau |
| 2005/0121466 | A1 | 6/2005 | Sher et al. |
| 2005/0143857 | A1 | 6/2005 | Chirnomas |
| 2005/0166761 | A1 | 8/2005 | Jones et al. |
| 2005/0166766 | A1 | 8/2005 | Jones et al. |
| 2005/0167493 | A1 | 8/2005 | Barton et al. |
| 2005/0175767 | A1 | 8/2005 | Gerber |
| 2005/0178144 | A1 | 8/2005 | Crisp |
| 2005/0178793 | A1 | 8/2005 | Cheng et al. |
| 2005/0201196 | A1 | 9/2005 | Gerber |
| 2005/0205666 | A1 | 9/2005 | Ward et al. |
| 2005/0258961 | A1 | 11/2005 | Kimball et al. |
| 2005/0269360 | A1 | 12/2005 | Piatnik et al. |
| 2005/0276883 | A1 | 12/2005 | Jeffrey et al. |

| | | | |
|---|---|---|---|
| 2005/0284885 | A1 | 12/2005 | Kadyk et al. |
| 2006/0000851 | A1 | 1/2006 | Girard et al. |
| 2006/0036454 | A1 | 2/2006 | Henderson |
| 2006/0043101 | A1 | 3/2006 | Bhimani et al. |
| 2006/0043111 | A1 | 3/2006 | Jennings et al. |
| 2006/0051614 | A1 | 3/2006 | Su et al. |
| 2006/0054614 | A1 | 3/2006 | Baxter et al. |
| 2006/0081653 | A1 | 4/2006 | Boland et al. |
| 2006/0102645 | A1 | 5/2006 | Walker et al. |
| 2006/0108415 | A1 | 5/2006 | Thomas et al. |
| 2006/0111978 | A1 | 5/2006 | Tietzen et al. |
| 2006/0113323 | A1 | 6/2006 | Jones |
| 2006/0115570 | A1 | 6/2006 | Guerrero et al. |
| 2006/0115572 | A1 | 6/2006 | Guerrero et al. |
| 2006/0131329 | A1 | 6/2006 | Sayers et al. |
| 2006/0144244 | A1 | 7/2006 | Girard et al. |
| 2006/0157504 | A1 | 7/2006 | Barker et al. |
| 2006/0172056 | A1 | 8/2006 | Tobin et al. |
| 2006/0174778 | A1 | 8/2006 | Greiwe |
| 2006/0180610 | A1 | 8/2006 | Haskayne |
| 2006/0180647 | A1 | 8/2006 | Hansen |
| 2006/0191964 | A1 | 8/2006 | Ziesel |
| 2006/0192003 | A1 | 8/2006 | Chung |
| 2006/0213928 | A1 | 9/2006 | Ufheil et al. |
| 2006/0224696 | A1 | 10/2006 | King et al. |
| 2006/0261156 | A1 | 11/2006 | Brown |
| 2007/0009365 | A1 | 1/2007 | Litterst et al. |
| 2007/0016852 | A1 | 1/2007 | Kim et al. |
| 2007/0044820 | A1 | 3/2007 | Chan et al. |
| 2007/0051747 | A1 | 3/2007 | Landers et al. |
| 2007/0114243 | A1 | 5/2007 | Kershaw et al. |
| 2007/0114244 | A1 | 5/2007 | Gatipon et al. |
| 2007/0124204 | A1 | 5/2007 | De Boer et al. |
| 2007/0205220 | A1 | 9/2007 | Rudick et al. |
| 2007/0205221 | A1 | 9/2007 | Carpenter et al. |
| 2007/0207040 | A1 | 9/2007 | Hughes et al. |
| 2007/0212468 | A1 | 9/2007 | White et al. |
| 2007/0251260 | A1 | 11/2007 | Baxter et al. |
| 2007/0252709 | A1 | 11/2007 | Collins et al. |
| 2007/0255450 | A1 | 11/2007 | Mazur et al. |
| 2007/0267441 | A1 | 11/2007 | van Opstal et al. |
| 2007/0272317 | A1 | 11/2007 | Kiopfenstein et al. |
| 2007/0299555 | A1 | 12/2007 | Walker et al. |
| 2008/0004954 | A1 | 1/2008 | Horvitz |
| 2008/0004973 | A1 | 1/2008 | Rothschild |
| 2008/0023488 | A1 | 1/2008 | Guerrero et al. |
| 2008/0029541 | A1 | 2/2008 | Wallace et al. |
| 2008/0041876 | A1 | 2/2008 | Frank et al. |
| 2008/0051193 | A1 | 2/2008 | Kaminkow et al. |
| 2008/0116262 | A1 | 5/2008 | Majer |
| 2008/0142548 | A1 | 6/2008 | Moen et al. |
| 2008/0173705 | A1 | 7/2008 | Girard et al. |
| 2009/0014464 | A1 | 1/2009 | Adbelmoteleb et al. |
| 2009/0065520 | A1 | 3/2009 | Peters et al. |
| 2009/0065570 | A1 | 3/2009 | Peters et al. |
| 2009/0069930 | A1 | 3/2009 | Peters et al. |
| 2009/0069931 | A1 | 3/2009 | Peters et al. |
| 2009/0069934 | A1 | 3/2009 | Newman et al. |
| 2009/0069947 | A1 | 3/2009 | Newman |
| 2009/0069949 | A1 | 3/2009 | Carpenter et al. |
| 2009/0070234 | A1 | 3/2009 | Peters et al. |

FOREIGN PATENT DOCUMENTS

| | | | |
|---|---|---|---|
| DE | 37 09 155 | A1 | 10/1987 |
| DE | 20312091 | | 10/2003 |
| EP | 0104447 | A2 | 4/1984 |
| EP | 0105017 | B1 | 4/1984 |
| EP | 0112638 | A2 | 7/1984 |
| EP | 0136005 | A1 | 4/1985 |
| EP | 0158096 | A2 | 10/1985 |
| EP | 0175815 | A2 | 4/1986 |
| EP | 0083467 | A1 | 7/1998 |
| EP | 1460029 | | 9/2004 |
| EP | 1626375 | A1 | 2/2006 |
| EP | 1905730 | | 4/2008 |
| EP | 1910095 | | 4/2008 |
| FR | 2624844 | A | 6/1989 |
| GB | 2303354 | A1 | 2/1997 |
| GB | 2416757 | A | 9/2004 |
| GB | 2429694 | | 9/2005 |
| GB | 2442223 | | 4/2008 |
| JP | 09134481 | | 5/1997 |
| WO | 8809766 | | 12/1988 |
| WO | 9850165 | A1 | 11/1998 |
| WO | 00/68136 | | 5/2000 |
| WO | 0065316 | A1 | 11/2000 |
| WO | 0211087 | A1 | 2/2002 |
| WO | 02/057178 | | 7/2002 |
| WO | 02059035 | A2 | 8/2002 |
| WO | 03107110 | A2 | 12/2003 |
| WO | 2004036515 | A1 | 4/2004 |
| WO | 2005/102906 | | 3/2005 |
| WO | 2005018788 | A1 | 3/2005 |
| WO | 2005/068836 | | 7/2005 |
| WO | 2005/070816 | | 8/2005 |
| WO | 2005091236 | A1 | 9/2005 |
| WO | 2005/111955 | | 11/2005 |
| WO | 2005111955 | A1 | 11/2005 |
| WO | 2006/013362 | | 2/2006 |
| WO | 2006/019523 | | 2/2006 |
| WO | 2006012916 | | 2/2006 |
| WO | 2006/076733 | | 7/2006 |
| WO | 2006101394 | A | 9/2006 |
| WO | 2006101394 | A2 | 9/2006 |
| WO | 2006070257 | | 10/2006 |
| WO | 2006131431 | A1 | 12/2006 |
| WO | 2007/002575 | | 1/2007 |
| WO | 2007/056407 | | 5/2007 |
| WO | 2007070032 | A1 | 6/2007 |
| WO | 2007117784 | A2 | 10/2007 |
| WO | 2007127525 | A2 | 11/2007 |
| WO | 2007136904 | A2 | 11/2007 |
| WO | 2007136905 | A2 | 11/2007 |
| WO | 2007146452 | A2 | 12/2007 |
| WO | 2008/015097 | | 2/2008 |
| WO | 2009012011 | A2 | 1/2009 |
| WO | 2009012012 | A1 | 1/2009 |
| WO | 2009012013 | A1 | 1/2009 |
| WO | 2009032874 | A2 | 3/2009 |
| WO | 2009032875 | A2 | 3/2009 |
| WO | 2009032877 | A2 | 3/2009 |
| WO | 2009032911 | A1 | 3/2009 |
| WO | 2009032929 | A2 | 3/2009 |
| WO | 2009032938 | A2 | 3/2009 |
| WO | 2009032941 | A2 | 3/2009 |
| WO | 2009032942 | A2 | 3/2009 |
| WO | 2009032946 | A1 | 3/2009 |

OTHER PUBLICATIONS

International Search Report and Written Opinion for PCT/US2009/035414 dated Mar. 23, 2009.

International Search Report and Written Opinion for PCT/US2009/035407 dated Apr. 28, 2009.

International Search Report and Written Opinion for PCT/US2008/075277 dated Apr. 24, 2009.

International Search Report and Written Opinion for PCT/US2008/075281 dated Jun. 26, 2009.

International Search Report and Written Opinion for PCT/US2008/075235 dated Feb. 4, 2009.

International Search Report and Written Opinion for PCT/US2008/075287 dated Feb. 18, 2009.

International Search Report and Written Opinion for PCT/US2008/075272 dated Apr. 6, 2009.

International Search Report and Written Opinion for PCT/US2008/075179 mailed on Aug. 24, 2009.

Disclosure under 37 C.F.R. 1.56, submitted Apr. 4, 2011.

Lancer, Redirect your store traffic from the cooler to your more profitable post-mix fountain area by adding fun and creating excitement; FS Series (Apr. 2003); p. 1-4.

International Preliminary Report on Patentability for PCT/US2008/075179 dated Jan. 15, 2010.

Notice of Allowance for U.S. Appl. No. 11/276,550 mailed Mar. 19, 2010.

Ex Parte Quayle for U.S. Appl. No. 11/276,550 mailed Dec. 23, 2009.

Final Office Action for U.S. Appl. No. 11/276,550 mailed Oct. 27, 2009.

Non-final Office Action for U.S. Appl. No. 11/276,550 mailed May 12, 2009.
Non-final Office Action for U.S. Appl. No. 11/276,550 mailed Dec. 8, 2008.
Non-final Office Action for U.S. Appl. No. 11/276,550 mailed Aug. 29, 2008.

* cited by examiner

| | Diluent Components 144 | | | | | Flavor Components 146 | | Additive Components 148 | |
|---|---|---|---|---|---|---|---|---|---|
| | Water 220 | Carbonated Water 222 | Ice 224 | Milk 226 | Yogurt 228 | Juice Con-centrate 230 | Other Flavor 232 | Vitamins 236 | Natural Flavor 238 |
| Juice 202 | X | | | | | X | | X | |
| Juice Mixture 204 | X | | | | | X | | X | |
| Juice Blend 206 | X | | | | | X | | X | X |
| Sparkling Juice 208 | | X | | | | X | | X | |
| Juice Milk 210 | X | | | X | | X | | X | X |
| Other Flavored Milk 212 | X | | | X | | | | | X |
| Juice Yogurt 214 | | | | | X | X | | X | X |
| Ice Juice Smoothie 216 | X | | X | X | | X | | X | X |
| Yogurt Juice Smoothie218 | X | | | X | X | X | | X | X |

FIG. 2

SYSTEMS AND METHODS OF SELECTING AND DISPENSING PRODUCTS

CROSS-REFERENCE TO RELATED APPLICATION

This application claims the benefit of co-pending provisional application U.S. Ser. No. 60/970,359, filed Sep. 6, 2007, which is hereby incorporated by reference in its entirety.

TECHNICAL FIELD

The present disclosure generally relates to systems and methods of dispensing products, and more particularly relates to systems and methods of dispensing products based at least in part upon a selection of a user.

BACKGROUND

The marketplace is fragmented by a wide variety of prepackaged beverage products. Each beverage product may have a distinct taste or flavor. Despite the differences in taste, however, many of the beverage products include common ingredients. For example, a large number of beverage products may include the diluent water.

Some beverage dispensing systems may capitalize on the commonality of ingredients. The ingredients may be separated from each other, and the system may create the beverage by combining the ingredients in response to consumer demand. For example, U.S. Pat. No. 4,753,370 entitled "Tri-Mix Sugar Based Dispensing System" and filed on Mar. 11, 1987, incorporated by reference herein in its entirety, discloses a beverage dispensing system that may create of a variety of beverage products by combining separate diluents and flavoring agents with one universal sweetener.

Such beverage dispensing systems are typically not employed to produce juice. Because of the volume of the juice concentrate, these systems normally require a relatively large footprint in order to provide a wide range of different juices. Juice dispensing systems that enable creating a number of different juices and yet have a comparatively small footprint are disclosed in U.S. Ser. No. 11/276,549 entitled "Juice Dispensing System" filed on Mar. 6, 2006, U.S. Ser. No. 11/777,309 entitled "Dispenser for Beverages Including Juices" filed on Jul. 13, 2007, U.S. Ser. No. 11/777,314 entitled "Clean in Place System for Beverage Dispensers" filed on Jul. 13, 2007, and U.S. Ser. No. 11/777,303 entitled "Flow Sensor" filed on Jul. 13, 2007, each being incorporated by reference herein in its entirety.

Although some known beverage dispensing systems may capitalize on the commonality of ingredients, many beverage dispensing systems do not capitalize on the innate ability to dispense user-configured products. Instead, beverage dispensing systems typically dispense branded products that have been market tested and are readily available in prepackaged containers in the marketplace. One reason why beverage dispensing systems typically do not dispense user-configured products is that the user may inadvertently formulate a product having an undesirable configuration, and therefore may be displeased with the system. A desirable beverage dispensing system may enable the user to configure the product while limiting the freedom of the user in selecting a product outside of certain tested ranges. Such a beverage dispensing system may ensure the dispensed product has a desirable flavor and consistency.

SUMMARY

Embodiments of a dispensing system for dispensing a number of products to a user are disclosed. The dispensing system may include an input/output device and a dispenser. The input/output device may be adapted to receive a selection of one of the products from the user. The dispenser may be adapted to dispense a plurality of diluent components. The diluent components and a ratio of the diluent components may correspond at least in part to the selection of the user.

The dispenser also may be adapted to dispense one or more flavoring components. The one or more flavoring components may correspond at least in part to one or more flavor selections of the user. The one or more flavoring components may comprise juice concentrates. The dispenser may be adapted to create a first juice concentrate from a universal juice base and a first concentrated flavoring agent, and the dispenser may be adapted to create a second juice concentrate from the universal juice base and a second concentrated flavoring agent. The diluent components may include water, milk, and yogurt. The products may include juice, a juice-flavored milk, a juice-flavored smoothie, and a juice-flavored yogurt.

Embodiments of a dispensing system are also disclosed. The dispensing system may include an input/output device and a dispenser. The input/output device may be adapted to receive a plurality of selections. The selections may include one or more diluent selections and one or more diluent intensity selections. The dispenser may be adapted to dispense one or more diluent components. The one or more diluent components may correspond at least in part to the one or more diluent selections. A ratio of the one or more diluent components may correspond at least in part to the one or more diluent intensity selections.

The input/output device may comprise a display that visually presents one or more diluent options and one or more pre-defined combinations of diluent options. The input/output device may be adapted to limit the one or more diluent selections to either one of the diluent options or one of the pre-defined combinations of diluent options.

The input/output device may comprise an input mechanism. The input mechanism may be adapted to be adjusted along a continuous range of positions. The input/output device may be adapted to receive each of the diluent selections when the input mechanism is adjusted to one location on the continuous range of positions. The continuous range of positions may include a first discrete position, a second discrete position, and an area. The first discrete position may indicate a first diluent option. The second discrete position may indicate a second diluent option. The area may be between the first and second discrete positions. The area may indicate a combination of the first and second diluent options. The first and second discrete positions may be separated by a total distance. The input/output device may be further adapted to receive the diluent intensity selections when the input mechanism is adjusted to the location on the continuous range of positions. The location may be a first distance from the first discrete position and a second distance from the second discrete position. A relative relationship between the first distance and the total distance may indicate the relative amount of the first diluent selection and a relative relationship between the second distance and the total distance may indicate a relative amount of the second diluent selection.

The input/output device may include a display that visually presents a continuum of options to the user. The continuum may visually illustrate a plurality of diluent options and a plurality of diluent intensity options. The input mechanism may be adapted to select each of the one or more diluent selections and each of the one or more diluent intensity selections from the continuum of options.

Embodiments of a method are also described below. The method may include presenting a plurality of options to the user. The options may include a plurality of diluent options and a plurality of diluent intensity options. The method may also include receiving a plurality of selections from the user. The selections may include one or more diluent selections and one or more diluent intensity selections. The method may further include determining one or more diluent components. The diluent components may be determined based at least in part on the diluent selections. The method also may include determining relative amounts of the diluent components. The relative amounts may be determined based at least in part on the diluent intensity selections. The method additionally may include dispensing a product that includes the relative amounts of the diluent components.

Presenting a plurality of options to the user may include presenting one or more pre-defined combinations of diluent options to the user. The method may further include limiting the one or more diluent selections to either one of the diluent options or one of a plurality of pre-defined combinations of diluent options. Receiving a plurality of selections from the user may include receiving an indication of a location of an input mechanism. The location may be associated with each of the one or more diluent selections and each of the one or more diluent intensity selections.

Presenting a plurality of options to the user may comprise presenting a continuum of options to the user. The continuum of options may be two-dimensional graph that visually illustrates the diluent options according to relative amount in the product. In such embodiments, the continuum of options may visually illustrate each diluent option using a diluent intensity line. The diluent intensity line may have an amplitude that represents the diluent intensity options. Also in such embodiments, an end point of the continuum may be the same as a beginning point of the continuum. Presenting a continuum of options to the user may include presenting the continuum of options on a display. The end point of the continuum may be positioned adjacent the beginning point of the continuum on the display such that the continuum of options appears endless. Receiving a plurality of selections from the user may include receiving an indication of a location on the continuum. The location on the continuum may simultaneously indicate each of the one or more diluent selections and each of the one or more diluent intensity selections.

The options may further include one or more flavor options, and the selections may further include one or more flavor selections. The product may further include one or more flavoring components. The flavoring components may be determined at least in part by the flavor selections. In such embodiments, the flavoring components may comprise juice concentrates and the diluent components may comprise water, milk, and yogurt.

Other systems, devices, methods, features, and advantages of the disclosed systems and methods of selecting and dispensing products will be apparent or will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE FIGURES

In the following figures, matching reference numerals designate corresponding parts. Components in the figures are not necessarily drawn to scale.

FIG. 2 is a chart listing example products that may be formed by combining one or more flavoring components and one or more water or milk-based diluent components.

DETAILED DESCRIPTION

Figure 1:
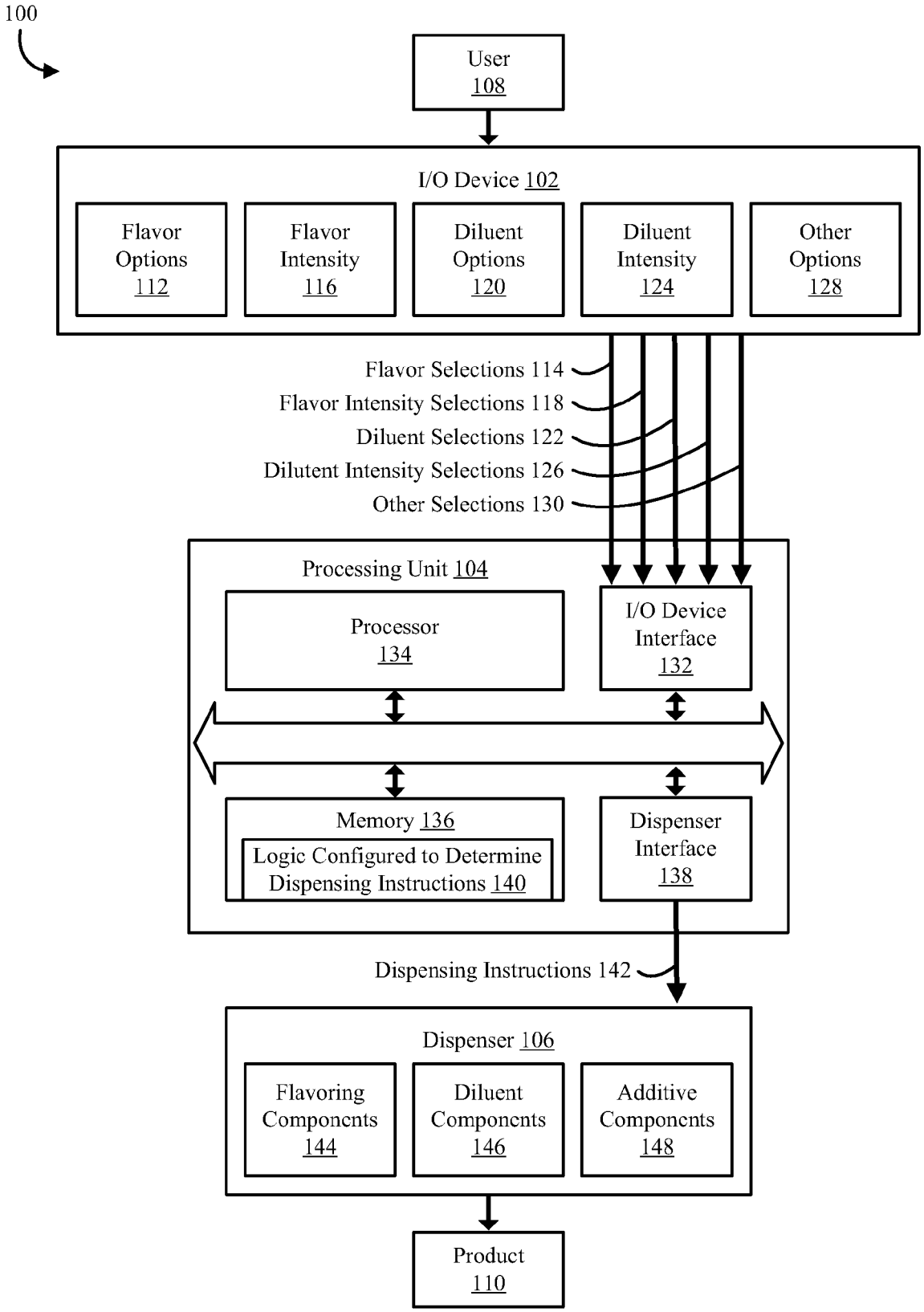
FIG. 1 is a block diagram illustrating an embodiment of a system for selecting and dispensing products.

Described below are embodiments of systems and methods of selecting and dispensing products. The systems and methods may be employed to dispense a product including a flavoring component and one or more diluent components, at least some of which components correspond to selections of a user. FIG. 1 is a block diagram illustrating an embodiment of a system 100 for selecting and dispensing products. The system 100 generally includes an input/output device 102, a processing unit 104, and a dispenser 106. The input/output device 102 may be adapted to provide a number of options to the user 108 and to receive a number of selections from the user 108. The processing unit 104 may instruct or control the dispenser 106 based at least in part upon the selections of the user 108. The dispenser 106 may be adapted to dispense a product 110 corresponding to the selections of the user 108.

More specifically, the input/output device 102 may be adapted to present a number of flavor options 112 to the user 108 and to receive one or more flavor selections 114 from the user 108. Example flavor options 112 include apple, orange, grape, cranberry, pineapple, grapefruit, and guava, among others. From these flavor options 112, an example flavor selection 114 may be apple. In some cases, the user 108 may make multiple flavor selections 114. In such cases, the input/output device 102 may present flavor intensity options 116 to the user 108 and may receive flavor intensity selections 118 from the user 108. The user 108 may select the flavor intensity selections 118 from among the flavor intensity options 116. The flavor intensity selections 118 may indicate the relative contributions of the selected flavors to the flavor of the product 110. For example, the user 108 may make flavor selections 114 of both apple and cranberry, and the user 108 may make flavor intensity selections 118 of 40% apple and 60% cranberry. In other cases, the input/output device 102 may not present flavor intensity options 116 to the user 108. For example, the flavor intensity options 116 may not be presented if the user 108 is permitted to select at most one flavor at a time. As another example, the flavor intensity options 116 may not be presented if the system 100 is adapted to determine the relative contributions of the selected flavors to the product 110. In fact, the input/output device 102 may not be adapted to present flavor options 112 or to receive flavor selections 114, in which case the products 110 dispensed by the dispenser 106 may not correspond to a flavor preference of the user 108.

The input/output device 102 also may be adapted to present a number of diluent options 120 to the user 108 and to receive one or more diluent selections 122 from the user 108. For example, the user 108 may be presented with diluent options 120 that include water-based diluent options and milk-based diluent options. Examples of water-based diluent options 120 include still water, carbonated water, and ice, while examples of milk-based diluent options include dairy milk, soy milk, and yogurt. Other example diluent options 120 may indicate the product 110 without expressly indicating the diluent components or ingredients to be employed by the dispenser 120 in formulating the product 110. Examples of such diluent options 120 may include juice, juice milk, milk, smoothie, and yogurt, as described in further detail below. From the diluent options 120, the user 108 may make one or more diluent selections 122. For example, the user 108 presented with the example diluent options 120 listed above may make the diluent selection 122 of water. In some cases, the user 108 may make multiple diluent selections 122. In such cases, the input/output device 102 may present diluent intensity options 124 and may receive diluent intensity selections 126 from the user 108. The user 108 may select the diluent intensity selections 126 from among the diluent intensity options 124. The diluent intensity selection 122 may indicate the relative amount of the diluent selection 122 in comparison to other diluent selections 122, for example. The user 108 may make diluent selections 122 of water and milk, in which case the user 108 may make diluent intensity selections 126 of 40% water and 60% milk. It should be noted that the flavor and diluent options 112, 120 disclosed above are provided by way of example and that any other options may be employed.

In some cases, the input/output device 102 may be further adapted to present one or more other options 128 to the user 108 and to receive one or more other selections 130 from the user 108. Examples of other options 128 and other selections 130 may be indications of the size of the product 110 and additives to be incorporated into the product 110. For example, the user 108 may be presented with the other option 128 of adding extra vitamin C or calcium to the product 110, among others. Another example may be a dispense option, which may indicate that the user 108 has completed formulating the product 110.

The processing unit 104 may be adapted to instruct the dispenser 106 to dispense the product 110 based at least in part upon the selections of the user 108. The processing unit 104 may include an input/output device interface 132, a processor 134, a memory 136, and a dispenser interface 138. The input/output device interface 132 may be configured to communicate the selections of the user 108 to the processor 134 and/or memory 136. The memory 136 may store logic 140 that can be executed by the processor 134. The logic 140 may be configured to determine dispensing instructions 142 based at least in part on the selections of the user 108, as described below. The dispensing instructions 142 may indicate the type and amount of the constituent components of the product 110. The dispenser interface 138 may be configured to communicate the dispensing instructions 142 to the dispenser 106 or to control the dispenser 106 in accordance with the dispensing instructions 142, depending on the embodiment.

The dispenser 106 may be adapted to produce a product 110 that corresponds to the dispensing instructions 142. More specifically, the dispenser 106 may be adapted to combine one or more flavoring components 144 and one or more diluent components 146 to produce the product 110. The types and amounts of flavoring components 144 and diluent component 146 may be indicated by the dispensing instructions 142. In some cases, the dispenser 106 may also be adapted to combine one or more additive components 148, in which case the dispensing instructions 142 may further indicate the type and amount of the additive component 148.

The flavoring components 144 employed by the dispenser 106 may correspond to the flavor options 112 presented to the user 108 by the input/output device 102. In embodiments, the flavoring components 144 may comprise juice concentrates. For example, the flavoring components 144 may include apple juice concentrate, orange juice concentrate, grape juice concentrate, cranberry juice concentrate, pineapple juice concentrate, grapefruit juice concentrate, and guava juice concentrate, among others. In some embodiments, the dispenser 106 may form the juice concentrate from one or more constituent ingredients, as described in further detail below. Other flavoring components 144 are possible, such as a chocolate flavoring component, among others. The diluent components 146 may correspond to the diluent options 120 presented to the user 108 by the input/output device 102. For example, the diluent components 146 may include still water, carbonated water, ice, dairy milk, soy milk, and yogurt, among others. However, other diluent components 146 may be employed. In some embodiments, the dispenser 106 may form the diluent components from one or more constituent ingredients, as described in further detail below. Also in some cases, the diluent components 146 may not be apparent from the diluent options 120 presented by the input/output device 102. For example, the diluent option 120 of juice may correspond to the diluent component 146 of water, while the diluent option 120 of smoothie may correspond to the diluent components 146 of water, milk, and yogurt, as described in further detail below. In some cases, the dispenser 106 may be adapted to combine one or more additive components 148 with the flavoring components 144 and the diluent components 146. The additive components 148 may be vitamins or natural flavors, among others.

Once the flavoring components 144, diluent components 146, and in some cases, additive components 148 are combined, the dispenser 106 may dispense the product 110. The product 110 may be any type of product depending on the options presented on the input/output device 102 and the selections entered by the user 108.

FIG. 2 is a chart listing example products 110 that may be formed by combining one or more flavoring components 144 and one or more water or milk-based diluent components 146. Specifically, the product 110 may be one of a juice 202, a combination of juices 204, a juice blend 206, a sparkling juice 208, a juice-flavored milk 210, a juice-flavored yogurt 214, a juice-flavored ice smoothie 216, and a juice-flavored yogurt smoothie 218, among others. Further, the product 110 may be a variation of any of these products or a combination of any number of these products. In embodiments, the product 110 may be an incremental combination of two of these products, as described with reference to FIG. 7 below.

The juice 202 may be formed from juice concentrate 230 and water 220. The juice combination 204 may be formed from a number of juice concentrates 230 and water 220. The juice blend 206 may be formed from juice concentrate 230, water 220, and other natural flavors 238. The sparkling juice 208 may be formed from juice concentrate 230 and carbonated water 220. The juice-flavored milk 210 may be formed from juice concentrate 230, water 220, and milk 226. The other-flavored milk 226 may be formed from water 220, milk 226, and a flavoring component 144 other than juice concentrate 230, such as a chocolate flavoring component. The juice yogurt 228 may be formed from juice concentrate 230 and yogurt 228. The juice-flavored ice smoothie 216 may be formed from juice concentrate 230, water 220, milk 226, and ice 224. The juice-flavored yogurt smoothie 218 may be formed from juice concentrate 230, water 220, milk 226, and yogurt 228. Other additive components 148 such as vitamins 236 and natural flavors 238 may be incorporated as identified in FIG. 2 or in any other manner, depending on the embodiment. Also, the juice concentrate 230 may be a combination of multiple different juice concentrates. Further, the products 110 listed in FIG. 2 may include components other than those listed in FIG. 2 or may omit components listed in FIG. 2.

Figure 3:
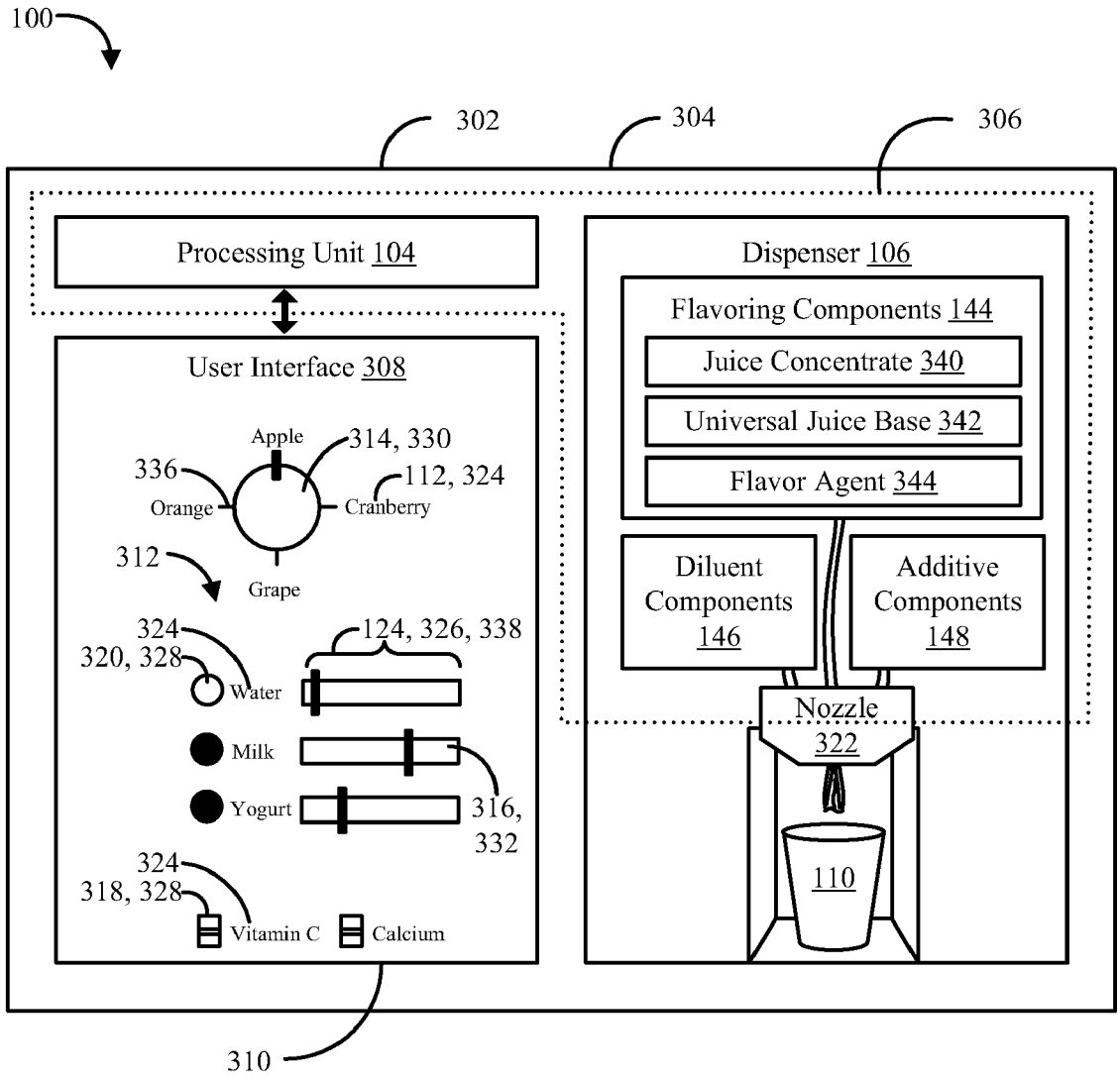
FIG. 3 is a schematic view of an embodiment of the system for dispensing products, illustrating the system incorporated into a housing.

FIG. 3 is a schematic view of an embodiment of the system 100 for selecting and dispensing products 110, illustrating the system 100 incorporated into a housing 302. The housing 302 includes an exterior 304 and an interior 306 (indicated by the dashed line). As shown, the input/output device 102 may be a user interface 308 positioned on the exterior 304 of the housing 302. The user interface 308 may include a display 310 and a number of input mechanisms 312. The display 310 may be any physical or electronic display that is configured to visually present the options to the user 108. An example of a physical display may be a physical poster mounted on the housing 302, while an example of an electronic display may be a monitor. The input mechanisms 312 may be any devices that are configured to receive the selections of the user 108. Examples of input mechanisms 312 include dials 314, sliders 316, switches 318, and buttons 320, among others. Some input mechanisms 312 may be physical devices adapted to be physically actuated by the user 108, while other input mechanisms 312 may be virtual devices adapted to be virtually controlled on a touch screen. Example user interfaces are described below with reference to FIGS. 4-8. Further, other types of user interfaces 308 or other input/output devices 102 may be employed depending on the embodiment.

The user interface 308 may be operationally related to the processing unit 104, which may be positioned on the interior 306 of the housing 302, as shown. In turn, the processing unit 104 may be operationally related to the dispenser 106. The dispenser 106 may be at least partially positioned on the interior 306 of the housing 302. More specifically, the dispenser 106 may include the flavoring components 144, the diluent components 146, and the additive components 148.

The flavoring components 144 and diluent components 146 are described as discrete components for the sake of clarity. In some cases, these components 144, 146 may be housed separately within the dispenser 106, while in other cases, one or more of these components 144, 146 may be created by the dispenser 106. For example, the dispenser 106 may be adapted to create the diluent component 146 of carbonated water by carbonating water from a still water source using a carbonator. As another example, the dispenser 106 may be adapted to create the diluent component 146 of dairy or soy milk from a still water source and a concentrated dairy or soy milk ingredient.

In cases in which the flavoring components 144 are juice concentrates, the dispenser 106 may be adapted to create a number of different flavored juice concentrates from one universal juice base 342. The universal juice base 342 may be a juice concentrate having a relatively low-level of flavor. For example, the universal juice base 342 may be a white grape juice concentrate or a pear juice concentrate, each of which may have a relatively generic or unidentifiable flavor. The universal juice base 342 also may be a juice concentrate that has had the essence of its flavor extracted, such as an apple juice concentrate from which the apple essence has been extracted. The universal juice base 342 may be formed by combining a universal juice concentrate with water. To form a specifically flavored juice concentrate, a relatively large amount of the universal juice base 342 may be combined with a relative small amount of the highly concentrated flavoring agent 344, such as an orange, apple, grape, cranberry, pineapple, or guava flavoring agent, among others. For example, each eight ounce volume of juice concentrate created by the dispenser 106 may include about 7.9 ounces of universal juice base 342 and about 0.1 ounces of highly concentrated flavoring agent 344. The 7.9 ounces of universal juice base 342 may include a 5:1 mixture of water and universal juice concentrate.

Such a dispenser 106 may have a relatively small footprint, as the dispenser 106 may not separately store each flavored juice concentrate that is employed by the dispenser 106. Alternatively, the dispenser 106 may separately house some flavored juice concentrates 340 and may create other flavored juice concentrates from the universal juice base 342. Whether the flavored juice concentrate is separately stored, such as flavored juice concentrate 340, or is formed from the universal juice base 342 may be determined at least in part by the size of the dispenser 106, the size of the space in which the dispenser 106 must fit, the anticipated need for the flavored juice concentrate in comparison with other flavored juice concentrates, and the desired quality of the flavored juice concentrate. Some flavored juice concentrates may be employed relatively more frequently by the dispenser 106, and therefore storing those flavored juice concentrates separately may not have a substantial impact on the size of the dispenser 106. For example, apple juice concentrate may be stored separately in the dispenser 106 while guava juice concentrate may be formed by the dispenser 106, as apple juice concentrate may be employed relatively more frequently than guava juice concentrate. As another example, orange juice concentrate may be stored separately in the dispenser 106, as orange juice concentrate formed from a universal juice base 342 may have a markedly different flavor than the flavor expected by the user 108. In view of the above disclosure, a range of configurations will be within the province of a person of skill.

The dispenser may be adapted to produce the product 110 in accordance with the dispensing instructions 142. With reference back to FIG. 1, the logic 140 may be configured to determine dispensing instructions 142 based at least in part on the selections of the user 108. The dispensing instructions 142 may indicate the type and amount of the flavoring components 144, diluent components 146, and additive components 148 to be incorporated into the product 110. For example, in response to one flavor selection 114, the logic 140 may include a separate juice concentrate 340 in the dispensing instructions 142, while in response to another flavor selection 114, the logic 140 may include the universal juice base 342 and one or more of the flavoring agents 344 in the dispensing instructions 142. In some embodiments, the dispensing instructions 142 may directly correspond to the selections of the user 108. Alternatively, the logic 140 may determine that additional components, fewer components, or alternative ratios of components are desirable, based on the selections of the user 108. For example, the logic 140 may determine that an additive component 148 may improve the product 110 configured by the user 108. Therefore, the logic 140 may include the additive component 148 in the dispensing instructions 142. Alternatively, the logic 140 may limit or prevent certain combinations as such combinations may yield a product 110 having an undesirable taste, color, or smell, among others. In such cases, the logic 140 may determine alternative dispensing instructions 142 based on the selections of the user 108.

The logic 140 may be configured to determine a volume of each component in the dispensing instructions 142, such that the volumes of the dispensed components add up to the total target volume of the product 110. More specifically, the logic 140 may be configured to vary the volume of the flavoring component 144 depending on the characteristics of the flavoring component 144 or a selected size of the product 110. Some flavoring components 144 may be relatively more concentrated, and therefore the logic 140 may be configured to ensure relatively smaller volumes of those flavoring components 144 are dispensed. However, other configurations are possible. The logic 140 also may be configured to determine the volume of the diluent component or components 146. The logic 140 may allocate the remaining volume of the product 110 among the one or more diluent components 146 according to the diluent intensity selections 124. The diluent intensity selections 124 may indicate a ratio of the one or more diluent components 146 to each other. The logic 140 may employ the diluent intensity selections 124 in combination with the volume of the flavoring component(s) 144 and the volume of the product 110 to determine a volume of each of the one or more diluent components 146.

For example, a diluent selection 122 of water and a diluent intensity selection 124 of 100% may indicate water accounts for 100% of the diluent volume of the product 110. Therefore, if the total volume of the product 110 is twelve-ounces and the volume of the flavoring component 144 is four-ounces, the logic 140 may determine an eight-ounce volume of water is appropriate. In such a case, the ratio of water to the other diluent components 146 may be 100%, and the ratio of the other diluent components 146 may be 0%. As another example, diluent intensity selections 124 of 10% water and 90% milk may indicate the product 110 includes a ratio of one part water for every nine parts of milk. Therefore, if the total volume of the product 110 is twelve-ounces and the volume of the flavoring component(s) 142 is two-ounces, the logic 140 may determine a one-ounce volume of water and a nine-ounce volume of milk are appropriate. However, a person of skill would understand that logic 140 having other configurations may be employed in accordance with the principles of the present disclosure.

In accordance with the dispensing instructions 142, the dispenser 106 may produce the product 110. The dispenser 106 may comprise a mixing nozzle 322 in fluidic communication with the flavoring components 144, the diluent components 146, and the additive components 148. The mixing nozzle 322 may be adapted to combine the components to produce the product 110. The mixing nozzle 322 may also be adapted to deliver the product 110 to exterior 304 of the dispenser 106 so that the user 108 may retrieve the product 110.

Turning now to the user interface 308, the user interface 308 may include input mechanisms 312 that are associated with the options so as to provide the user 108 with the desired degree of freedom in formulating the product 110. Some options may be discrete options 324 representing discrete choices. Example discrete options 324 include flavor options 112 and diluent options 120, among others. Each flavor option 112 may represent one discrete flavor and each diluent option 120 may represent one discrete diluent. Other options are incremental options 326 that incrementally vary along a continuous range. Example incremental options 326 include flavor intensity options 116 and diluent intensity options 124, which may represent a spectrum of potential contributions to the product 110.

The input mechanism 312 may be a binary input mechanism 328, a graduated input mechanism 330, an incrementally adjustable input mechanism 332, or a combination input mechanism 334, as described below. The binary input mechanism 328 may be adjusted between two discrete positions. In some cases, the binary input mechanism 328 may be associated with any one discrete option 324. In such cases, the binary input mechanism 328 may be engaged to select or de-select the one discrete option 324 independent of the other discrete options 324. One binary input mechanism 328 may be a button 320. The button 320 may be pressed to select or de-select the discrete option 324 associated with the button 320. Another binary input mechanism 328 may be a switch 318. The switch 318 may be flipped to select or de-select the discrete option 324 associated with the switch 318. For example, each additive option 128 may be independently selected by flipping the switches 318 in FIG. 3. In some cases, the user interface 308 may allow the user 108 to engage a number of binary input mechanisms 328 so that the user 108 may incorporate a combination of discrete options 324 into the product 110. For example, a number of diluent options 120 have been selected in FIG. 3 by pressing the corresponding buttons 320. In other cases, the user interface 308 may limit the number or combination of binary input mechanisms 312 that may be engaged. Such a limitation may control the number or combination of options that may be incorporated into the product 110.

The graduated input mechanism 330 may be adjusted among a number of discrete positions 336. In some cases, the graduated input mechanism 330 may be associated with a number of discrete options 324, each discrete option 324 being associated with one of the discrete positions 336. In such cases, the graduated input mechanism 330 may be adjusted among the discrete positions 336 to select any one of the discrete options 324. One graduated input mechanism 330 may be a dial 314. The dial 314 may have a number of discrete options 324 located at a number of discrete positions 336 about the dial 314. The user 108 may select at most one of the discrete options 324 by turning the dial 314 to the appropriate discrete position 336. Another graduated input mechanism 330 may be a slider 316. The slider 316 may have a number of discrete options 324 located at a number of discrete positions 336 along the slider 316. The user 108 may select at most one of the discrete options 324 by sliding the slider 316 to the appropriate discrete position 336. The graduated input mechanism 330 may limit the number or combination of discrete options 324 that the user 108 may select, as the user 108 may adjust the graduated input mechanism 330 to at most one discrete position 336 at a given time. An example is shown in FIG. 3. A number of flavor options 112 are associated with the dial 314, and the user 108 may select one flavor option 112 by turning the dial 314 to the corresponding discrete position 336.

The incrementally adjustable input mechanism 332 may be continuously adjusted along a continuous range 338. The continuous range 338 may correspond to a continuous set of incremental options 326. A minimum end of the continuous range 338 may correspond to a minimum incremental option 326, while a maximum end of the continuous range 338 may correspond to a maximum incremental option 326. Between the minimum end and the maximum end of the continuous range 338, the incremental options 326 may gradually increase from the minimum to the maximum, each incremental option 326 incrementally varying from the next adjacent incremental option 326. An example incrementally adjustable input mechanism 332 may be a dial 314 or a slider 316. The incremental options 326 may be indicated by a continuous range 338 positioned about the dial 314 or along the slider 316. The user 108 may select one incremental option 326 on the continuous range 338 by adjusting the dial 314 or slider 316 to one position.

In some embodiments, a number of incrementally adjustable input mechanisms 332 may be related to each other, so that adjusting one incrementally adjustable input mechanism 332 automatically adjusts the other related incrementally adjustable input mechanisms 332. More specifically, when the user 108 increases one incrementally adjustable input mechanism 332, the related incrementally adjustable input mechanisms 332 may be automatically decreased. An example is shown in FIG. 3. Each diluent option 120 is associated with a slider 316. The slider 316 indicates a continuous range 338 of diluent intensity options 124. The user 108 may adjust the slider 316 to select the contribution of the diluent to the product 110. The minimum end of the continuous range 338 indicates a minimum contribution of the diluent to the product 110, while the maximum end of the continuous range 338 indicates a maximum contribution of the diluent to the product 110. So that the relative contributions of all of the selected diluents add up to 100%, the sliders 316 may be operationally related to each other. The user 108 may adjust one or more of the sliders 316, and in response one or more related sliders 316 may be automatically adjusted. For example, the user interface 308 may adjust the other related sliders 316 in the embodiment shown in FIG. 3. Thus, when the user 108 slides the slider 316 associated with milk, the user interface 308 may automatically adjust the sliders 316 associated with water and yogurt, so that the contributions of the selected diluents add up to 100%.

Figure 4:
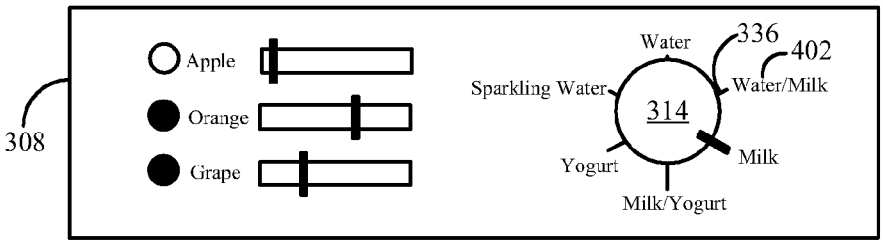
FIG. 4 is a schematic view of an embodiment of a user interface that presents pre-defined combinations of options to the user.

FIG. 4 is a schematic view of an embodiment of a user interface 308, in which pre-defined combinations 402 of options to the user 108. The pre-defined combination 402 of options may suggest specific groups of options and may allow the user 108 to simultaneously select each option in the group. In some cases, the pre-defined combination 402 of options may be associated with a discrete position 336 on the graduated input mechanism 330, so that moving the graduated input mechanism 330 to the discrete position 336 simultaneously selects each option in the pre-defined combination 402. Alternatively, the pre-defined combination 402 of options may be associated with the binary input mechanism 328 so that engaging the binary input mechanism 328 simultaneously selects each option in the pre-defined combination 402. Thus, the user interface 308 may allow the user 108 to combine some groups of options while preventing the user 108 from combining other groups.

For example, the dial 314 in FIG. 4 has either one diluent option 120 or a pre-defined combination of diluent options 120 at each discrete position 336 on the dial 314. Thus, the user 108 may turn the dial 314 to the appropriate discrete position 336 to make the diluent selection(s). Such pre-defined combinations 402 of options give the user 108 a degree of freedom while preventing the user 108 from making undesirable choices. For example, the user 108 may be able to combine both milk and yogurt, as such a combination may form a desirable product 110 comparable to a smoothie. However, the user 108 may be prevented from simultaneously selecting both water and yogurt, because such a combination may yield runny yogurt having an undesirable taste and appearance. The user 108 also may be prevented from simultaneously selecting both carbonated water and milk, because such a combination may result in undesirable foaming.

Figure 5:
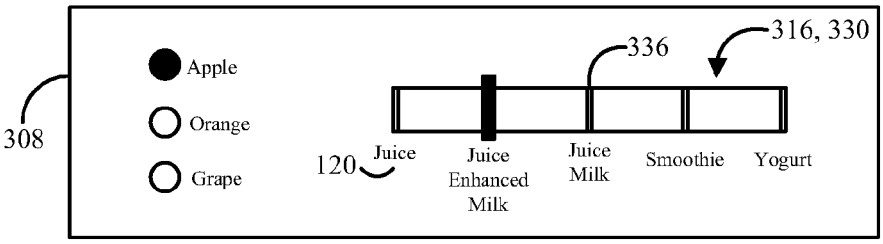
FIG. 5 is a schematic view of another embodiment of a user interface.

FIG. 5 is a schematic view of another embodiment of a user interface 308. The user interface 308 presents diluent options 120 that may enable the user 108 to envision the product 110 to be formed by the dispenser 108. More specifically, the diluent options 120 may indicate the product 110 to be formed from the selected diluents and a flavoring 144 component that is a juice concentrate. Each diluent option 120 may indicate one diluent or a pre-defined combination 402 of diluents, although the diluent option 120 may or may not expressly indicate the diluent or diluents to the user 108. For example, the diluent options 120 associated with the discrete positions 336 on the slider 316 in FIG. 5 are juice, juice milk, milk, smoothie, and yogurt. Selecting the diluent option 120 of juice may be equivalent to selecting the diluent option 120 of water, as the dispenser 106 is adapted to form juice from water and juice concentrate. Selecting the diluent option 120 of juice enhanced milk may be equivalent to selecting the diluent options 120 of water and milk, as the dispenser 106 is adapted to form juice enhanced milk from water, milk and juice concentrate. Selecting the diluent option 120 of juice milk may be equivalent to selecting the diluent option 120 of milk, as the dispenser 106 is adapted to form juice milk from milk and juice concentrate. Selecting the diluent option 120 of smoothie is equivalent to selecting the diluent options 120 of milk and yogurt, as the dispenser 106 is adapted to form a smoothie from milk, yogurt, and juice concentrate.

Figure 6:
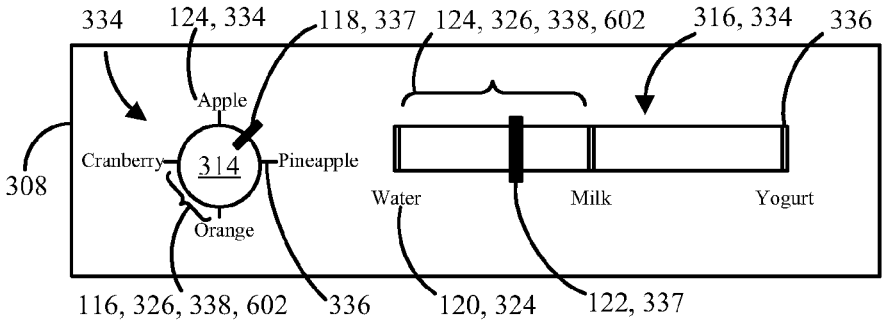
FIG. 6 is a schematic view of another embodiment of a user interface.

FIG. 6 is a schematic view of another embodiment of a user interface 308. The user interface 308 includes a combination input mechanism 334. The combination input mechanism 334 may include features of both the graduated and the incrementally adjustable input mechanisms. More specifically, a number of discrete options 324 may be associated with the combination input mechanism 334 at a number of discrete positions 336 along a continuous range of positions 338. The combination input mechanism 334 may be adjusted to select one of the discrete options 324 at one of the discrete positions 336. Further, an area 602 between two adjacent discrete positions 336 may correspond to a pre-defined combination 402 of the two adjacent discrete options 324. The combination input mechanism 334 may be adjusted into the area 602 to simultaneously select both discrete options 324 in the pre-defined combination 402.

One example of a combination input mechanism 334 is the dial 314 shown in FIG. 6. The dial 314 may be adjusted to one of four discrete positions 336 to select one of four flavor options 112: orange, pineapple, apple and cranberry. The dial 314 also may be adjusted to one of the areas 602 between two adjacent discrete positions 336 to select one of four pre-defined combinations 402 of flavor options 112: orange and pineapple, orange and cranberry, apple and pineapple, or apple and cranberry. Another example of a combination input mechanism 334 is the slider 316 shown in FIG. 6. The slider 316 may be adjusted among three discrete positions 336 to select one of three diluent options 120: water, milk, and yogurt. Further, the slider 316 may be adjusted to the area 602 between any two adjacent discrete positions 336 to select one of two pre-defined combinations 402 of diluent options 120: water and milk or milk and yogurt.

In some embodiments, the combination input mechanism 334 may also be adapted for selecting the incremental options 326. Such a combination input mechanism 334 may enable simultaneously selecting one or more discrete options 324, such as the flavors or diluents to be incorporated into the product 110, along with the corresponding incremental options 326, such as the intensity options that indicate the relative contributions of the selected flavors or diluents to the product 110. In FIG. 6, for example, the dial 314 is adapted for selecting flavor options 112. Therefore, the dial 314 may also be adapted for selecting flavor intensity selections 118 from among a continuous range 338 of flavor intensity options 116. Likewise, the slider 316 may be adapted for selecting diluent options 120. Therefore, the slider 316 also may be adapted for selecting diluent intensity selections 126 from among a continuous range 338 of diluent intensity options 124. One discrete position 336 may represent a maximum of one discrete option 324, and the next adjacent discrete position 336 may represent a minimum of the discrete options 324. The area 602 between the two discrete positions 336 may represent a continuous range 338 of intensity options, gradually decreasing from a maximum intensity to the minimum intensity.

Examples are shown in FIG. 6. The dial 314 includes four discrete positions 336 and four areas 602. Each discrete position 336 corresponds to one flavor option 112 and each area 602 corresponds to the pre-defined combination 402 of two adjacent flavor options 112. Each area 602 may also indicate the flavor intensity options 116 of the adjacent flavors. The flavor intensity options 116 may be inversely related so that as one flavor intensity option 116 increases, the other flavor intensity option 116 necessarily decreases. At any point in the area 602 the two flavor intensity options 116 correspond to 100% of the flavoring components 144 of the product 110. For example, the user 108 may indicate the flavor selections 114 of apple and pineapple by adjusting the dial 314 to a location 337 between the two discrete positions 336 associated with the flavor options 112 of apple and pineapple. The user 108 also may indicate the flavor intensity selection 118 of 50% apple by adjusting the dial 314 to a location 337 that, when measured from the discrete position 336 associated with the flavor option 112 of apple, is about 50% of the distance between the two discrete positions 336. The user 108 also may indicate the flavor intensity selection 118 of 50% pineapple by adjusting the dial 314 to a location 337 that, when measured from the discrete position 336 associated with the flavor option 112 of pineapple, is about 50% of the distance between the two discrete positions 336.

Similarly, the slider 316 includes three discrete positions 336 and two areas 602. Each discrete position 336 corresponds to one diluent option 120 and each area 602 corresponds to the pre-defined combination 402 of two adjacent diluent options 120. Each area 602 may also indicate the diluent intensity options 124 of the adjacent diluents. Thus, the user 108 may adjust the slider 316 to simultaneously register diluent selections 122 and diluent intensity selections 126. For example, the user 108 may indicate the diluent selections 122 of water and milk by adjusting the slider 316 to a location 337 between the discrete positions 336 associated with the diluent options 120 of water and milk. The slider 316 may be adjusted to a location 337 that, when measured from discrete position 336 associated with water, is about 25% of the distance between the discrete positions 336. Such a location 337 may indicate the diluent intensity selection 126 of 25% water. The location 337 also may be about 75% of the distance between the discrete positions 336, when measured from the discrete position 336 associated with milk. Thus, such a location 337 may indicate the diluent intensity selection of 75% milk.

It should be noted that the above embodiments of the user interface 308 are described by way of example, and that any combination of the above embodiments is possible. Further, it should be emphasized that the input mechanisms 312 described above may be implemented using a touch screen, in which case the input mechanism 312 may be virtual. By limiting the user 108 to certain options or pre-defined combination of options, the user interface 308 may provide the user 108 with a degree of freedom in formulating the product 108, while preventing the user 108 from making undesirable choices. Such a user interface 103 may enable the user 108 to configure products 110 that are not pre-packaged and readily available in the marketplace, and yet still have a desirable taste and consistency.

Figure 7:
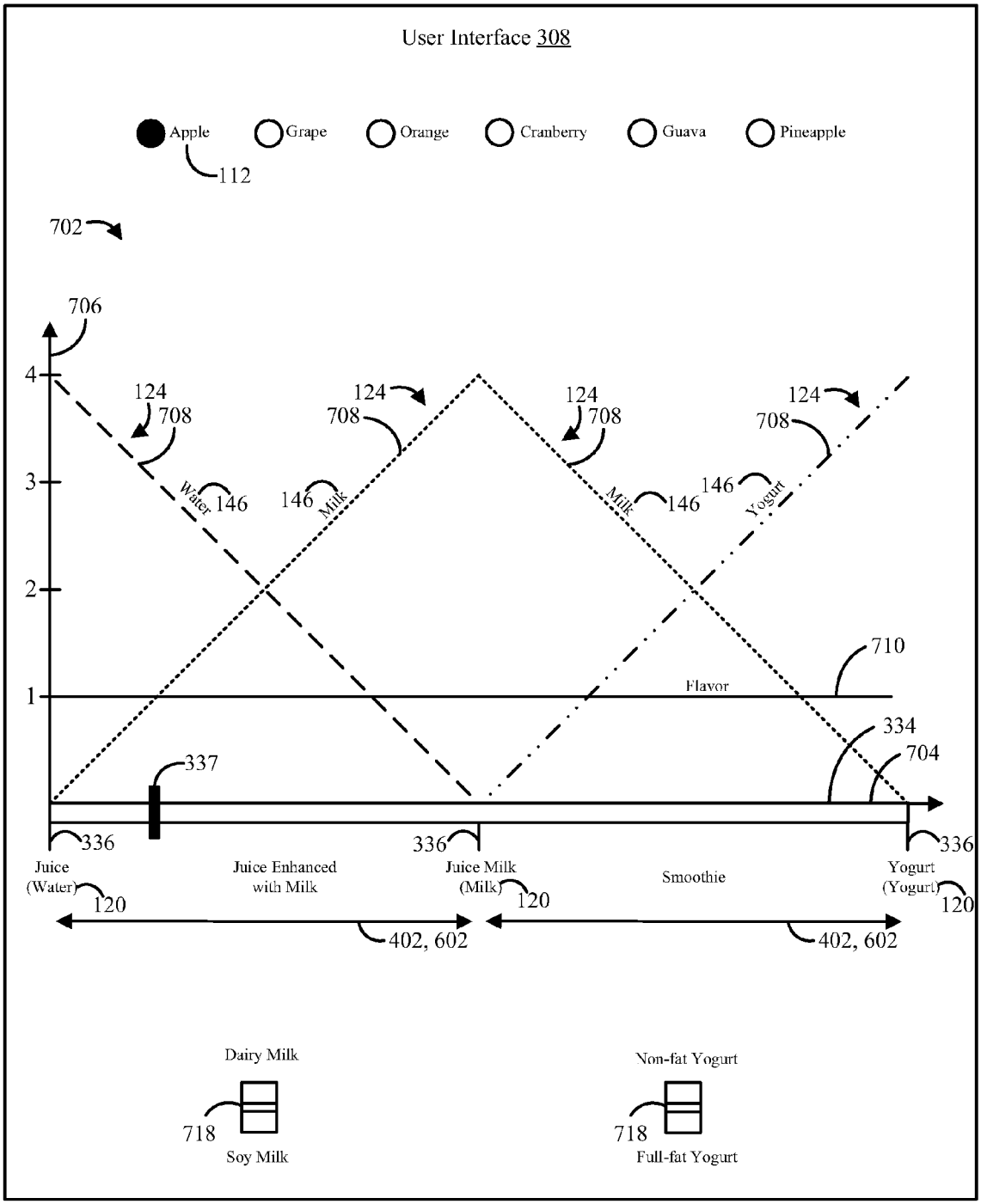
FIG. 7 is a schematic view of an embodiment of a user interface that presents a continuum of options to the user.

FIG. 7 is a schematic view of an embodiment of a user interface 308 that presents a continuum 702 of options to the user 108. The continuum 702 may be a two-dimensional graph that visually presents the diluent options 120 and the diluent intensity options 124 to the user 108. Such a continuum 702 may aid the user 108 in envisioning the product 110 to be dispensed by the dispenser 106. Further, such a continuum 702 may limit the consumer to certain options or pre-defined combinations of options, ensuring the user 108 selects a product 108 having a desirable taste and consistency.

As shown in FIG. 7, the continuum 702 may include a horizontal axis 704 and a vertical axis 706. The horizontal axis 704 may indicate the diluent options 120. More specifically, each discrete position 336 on the horizontal axis 704 may indicate one diluent option 120, and the area 602 between two adjacent discrete positions 336 may indicate a pre-defined combination 402 of two adjacent diluent options 120. Additionally, each diluent option 120 may be associated with a diluent intensity line 708. The diluent intensity line 708 may extend from the discrete position 336 associated with the diluent option 120 to the next adjacent discrete position 336. The diluent intensity line 708 may have a vertical amplitude that may visually represent the diluent intensity options 124 of the diluent option 120. In the illustrated embodiment, each diluent intensity line 708 may linearly decrease from a vertical maximum at the discrete position 336 to a vertical minimum at the next adjacent discrete position 336. Similarly, the diluent intensity line 708 of the next adjacent diluent may linearly increase from a vertical minimum at the discrete position 336 to a vertical maximum at the next adjacent discrete position 336. In other words, the area 602 between two discrete positions 336 may include two diluent intensity lines 708, as the area 602 corresponds to the combination of two diluent components 146. Together the two diluent intensity lines 708 may visually indicate how the two diluent components 146 combine to produce the product 110. The diluent intensity lines 708 may be inversely related and may crisscross or form an X, visually indicating that the relative amount of one diluent component 146 decreases as the relative amount of the other diluent component 146 increases. Thus, at any point on the horizontal axis 704, the contributions of the diluent components 146 to the product 110 add up to 100%. However, the continuum of options 702 may have other configurations. For example, the continuum 702 may be a pie chart, among others.

The continuum 702 may be visually presented to the user 108 in association with a combination input mechanism 334. The combination input mechanism 334 may be adjusted to select one location 337 on the horizontal axis 704. Selecting one location 337 on the horizontal axis 704 may simultaneously select each of the diluent options 120 and each of the diluent intensity options 124. More specifically, selecting the discrete position 336 on the horizontal axis 704 may select the corresponding one diluent option 120, while selecting a location 337 in the area 602 may select the corresponding combination of two diluent options 120. Additionally, selecting one location 337 on the horizontal axis 704 may also select the corresponding diluent intensity options 124. The relative distance of the location 337 from the discrete position 336 may indicate the relative amount of the diluent component 146 associated with the discrete position 336 to be incorporated into the product 110. Thus, by selecting one point on the horizontal axis 704, the user 108 may simultaneously select one or more diluent components 146 and may indicate the relative amounts of the diluent components 146 in the composition of the product 110.

It should be noted that the continuum 702 may be visually presented on a user interface 308 that also enables the user to select one or more flavor options 112, as described above. In such embodiments, the continuum 702 may also visually present a flavor intensity line 710 to the user 108. The flavor intensity line 710 may represent a relative amount of the flavoring components 144 in the product 110. As shown, the flavor intensity line 710 may be a flat line, although other flavor intensity lines 710 are possible. Further, the flavor intensity line 710 may be omitted from the continuum 702, in which case an indication of the flavor may not be visually presented to the user 108 on the continuum 702.

In FIG. 7, the discrete positions 336 on the horizontal axis 704 correspond to the following diluent options 120: water, milk, and yogurt. The areas 602 correspond to two different pre-defined combinations 402 of diluent options 120: milk and water, and milk and yogurt. The continuum 702 may also present other diluent options 120 to the user 108, as described above. For example, the diluent options 120 presented to the user 108 may include juice, juice milk, and yogurt. The area 602 on the horizontal axis 704 between the discrete positions associated with juice and juice milk may be indicating as corresponding to juice enhanced with milk, while the area 602 on the horizontal axis 704 between the discrete positions associated with juice milk and yogurt may be indicated as corresponding to a smoothie. Thus, by selecting one location 337 on the horizontal axis 704 of the continuum 702, the user 108 may select a product 110 having diluent components 146 that comprise 100% water, any combination of water and milk, 100% milk, any combination of milk and yogurt, or 100% yogurt. When such diluent components 146 are mixed with flavoring components 144 that are juice concentrates, the continuum 702 may represent a variety of products 110 ranging from straight juice at one end of the continuum 702 to spoonable yogurt at the other end of the continuum 702. Along the continuum 702 the products 110 may incrementally vary from juice to juice enhanced milk, juice milk, smoothie, and eventually, straight yogurt. Each location 337 on the horizontal axis 704 of the continuum 702 may correspond to an incrementally different product 110 with incrementally different properties. For example, the product 110 may be one of the products illustrated in FIG. 2 or any incremental combination of any two of those products. By associating the continuum 702 with a combination input mechanism 334, the user 108 may select among an infinite variety of products 110 by selecting a single location 337 on the horizontal axis 704 of the continuum 702.

It should be noted that the combination input mechanism 334 is a slider 316 in the illustrated embodiments, although other configurations are possible. For example a dial 314 may be employed. The dial 314 may be coupled to a separate visual indicator that indicates the location 337 on the horizontal axis 704, such that turning the dial 314 adjusts the visual indicator along the horizontal axis 704. In some embodiments, the user 108 may be able to select additional characteristics of at least some of the options presented on the continuum 702. Examples are shown in FIG. 7. The user 108 may be able to define the diluent option 120 of milk as being either dairy milk or soy milk. The user 108 also may be able to define the diluent option 120 of yogurt as being non-fat yogurt or full-fat yogurt. The user interface 308 may include input mechanisms 312 adapted for receiving the preferences of the user 108 regarding such characteristics. For example, in FIG. 7 a number of switches 718 are employed for this purpose, although other configurations are possible. It also should be noted that the continuum 702 may represent options other than diluent options 120 and diluent intensity options 124. Further, the diluent intensity lines 708 may increase or decrease in a non-linear fashion between adjacent discrete positions 336. Additional, the horizontal axis 704 and the vertical axis 706 may have other orientations.

Figure 8:
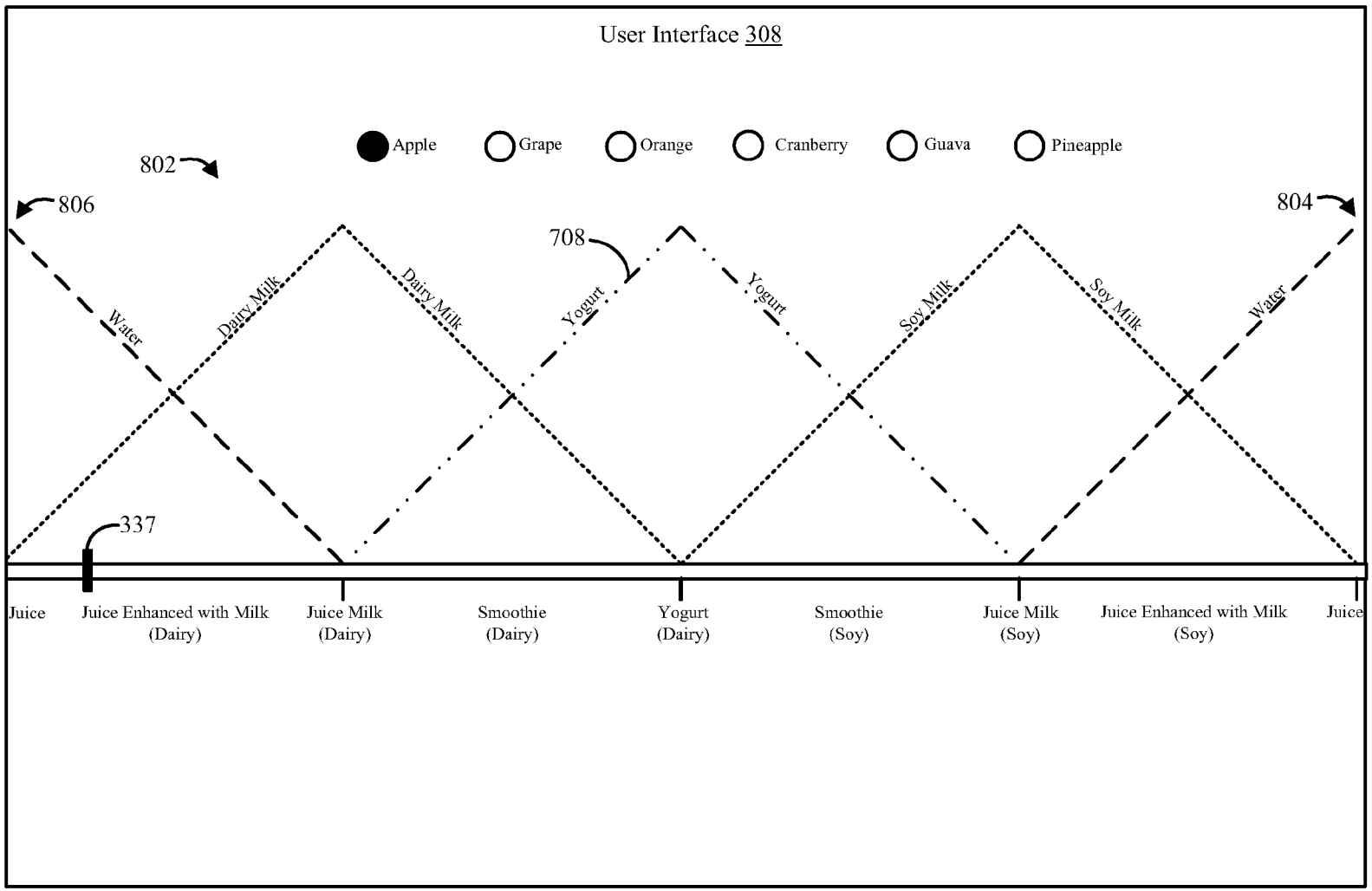
FIG. 8 is a schematic view of an embodiment of a user interface that presents a looped continuum of options to the user.

FIG. 8 is a schematic view of an embodiment of a user interface 308 that presents a looped continuum of options 802. The looped continuum 802 may have an end point 804 that is the same as a beginning point 806 of the continuum 802. The end point 804 and the beginning point 806 may be positioned adjacent each other to form a loop. The looped continuum 802 may seamlessly repeat after the full length of the looped continuum 802 has been traversed. Such a looped continuum 802 may be suited for visually displaying on a monitor or a touch screen, as the user 108 may continuously scroll along the horizontal axis 704 of the looped continuum 802 without reaching an end of the looped continuum 802.

Like the continuum 702, the looped continuum 802 may have a number of diluent intensity lines 708. For example, the looped continuum 802 may be formed by placing the continuum 702 adjacent a mirror-image of the continuum 702. In such an embodiment, the continuum 702 may include two locations 337 that correspond to the same product 110. Alternatively, one or more of the diluent options 120 and diluent intensity lines 124 may be changed to correspond to a different diluent. For example, the looped continuum 802 shown in FIG. 8 includes a separate diluent intensity line 724 for diary milk and soy milk. A range of other configurations are also possible.

Thus, the user 108 may receive a product 110 configured according to his preference. For example, the product 110 may be the equivalent of a branded product or an incremental combination of a number of branded products in embodiments. However, the configuration of the user interface 308 may safeguard the user 108 from selecting a product 110 having undesirable attributes. Further, the user interface 308 may present the options to the user 108 in a relatively intuitive manner, so that the user 108 may enter a relatively larger number of selections through a relatively smaller number of interactions with the user interface 308.

Figure 9:
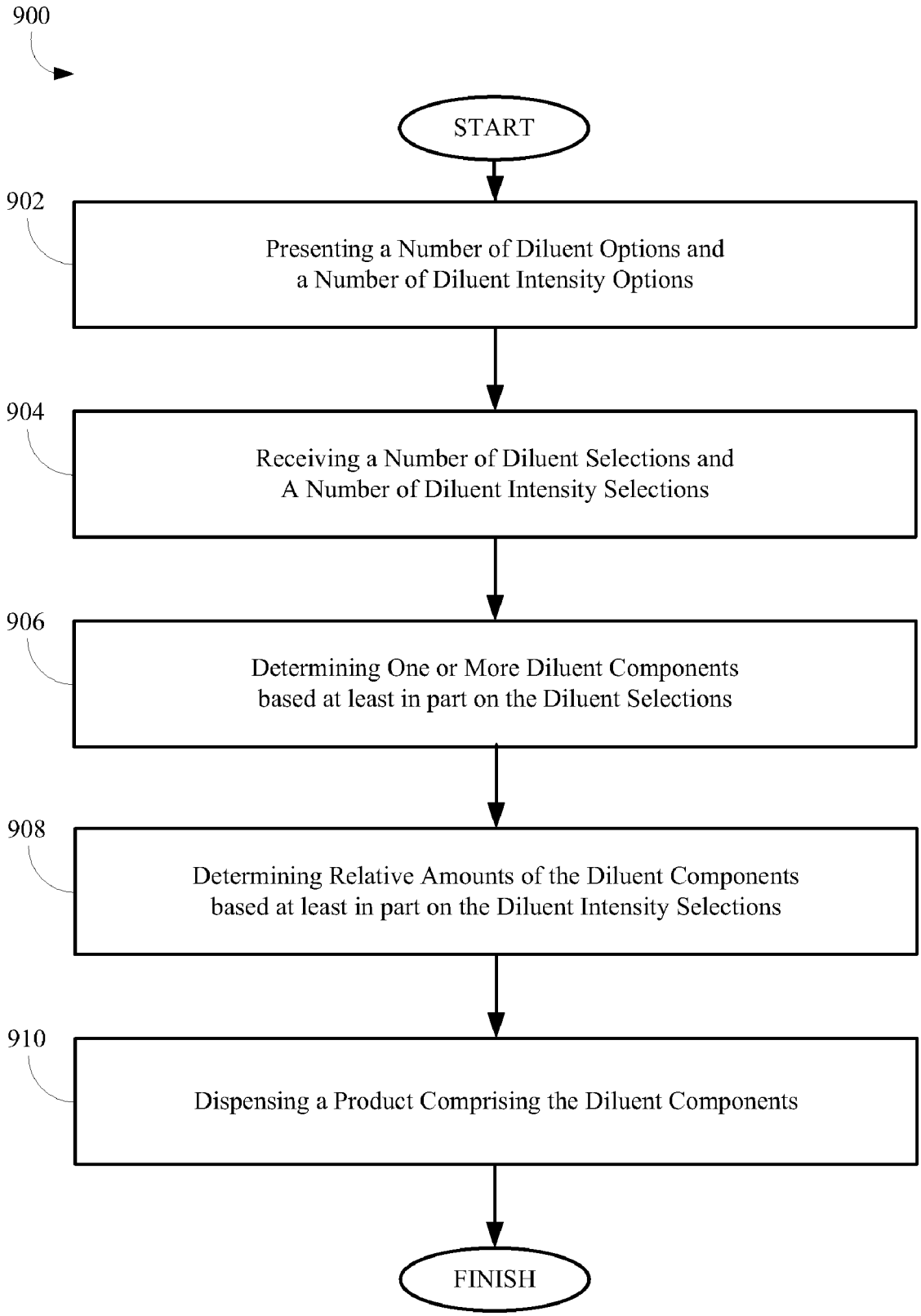
FIG. 9 is a block diagram illustrating an embodiment of a method of selecting and dispensing products.

A person of skill will appreciate that the description above also discloses a method 900 of selecting and dispensing products. FIG. 9 is a block diagram illustrating an embodiment of the method 900. In block 902, a number of options may be presented to the user. The options may include a number of diluent options and a number of diluent intensity options. In some embodiments, one or more pre-defined combinations of diluent options may be presented to the user. For example, a continuum of options may be presented to the user. The continuum of options may be two-dimensional graph that visually illustrates the diluent options according to relative amount in the product. The continuum of options may visually illustrate each diluent option using a diluent intensity line. The diluent intensity line may have an amplitude that represents the diluent intensity options. An end point of the continuum may be the same as a beginning point of the continuum. The continuum may be presented on a display, and the end point of the continuum may be positioned adjacent the beginning point of the continuum on the display such that the continuum of options appears endless. Other configurations are possible.

In block 904, a number of selections may be received from the user. The selections may include one or more diluent selections and one or more diluent intensity selections. In some embodiments, the diluent selections may be limited to either one of the diluent options or one of a number of pre-defined combinations of diluent options. In some embodiments, the user may enter the selections by moving an input mechanism to a location. The location may be associated with each of the one or more diluent selections and each of the one or more diluent intensity selections. In such embodiments, receiving a number of selections from the user may include receiving an indication of a location of an input mechanism. For example, the location may be a location on the continuum. The location on the continuum may simultaneously indicate each of the one or more diluent selections and each of the one or more diluent intensity selections.

In block 906, one or more diluent components may be determined. The diluent components may be determined based at least in part on the diluent selections. In block 908, relative amounts of the diluent components may be determined based at least in part on the diluent intensity selections.

In block 910, a product may be dispensed. The product may include the relative amounts of the diluent components. In some embodiments, the options presented in block 902 may further include one or more flavor options and the selections received in block 904 may further include one or more flavor selections. In such embodiments, the product dispensed in block 908 may further include one or more flavoring components. In such embodiments, the method may further include determining the flavoring components based at least in part on the flavor selections. Also in such embodiments, the flavoring components may include juice concentrates and the diluent components comprise water, milk, and yogurt.

While particular embodiments of systems and methods for selecting and dispensing products have been disclosed in detail in the foregoing description and figures for purposes of example, those skilled in the art will understand that variations and modifications may be made without departing from the scope of the disclosure. All such variations and modifications are intended to be included within the scope of the present disclosure, as protected by the following claims.

We claim:

1. A dispensing system for dispensing a number of products to a user, comprising:

an input/output device adapted to receive a selection of one of the products from the user;

a dispenser adapted to dispense a plurality of diluent components, the diluent components and a ratio of the diluent components corresponding at least in part to the selection of the user; and wherein the input/output device comprises a continuum for entering the selection comprising a two-dimensional graph that visually illustrates the plurality of diluent components according to relative amount in the product.

2. The system of claim 1, wherein:

the dispenser is further adapted to dispense one or more flavoring components, the one or more flavoring components corresponding at least in part to one or more flavor selections of the user.

3. The system of claim 2, wherein the one or more flavoring components comprises juice concentrates, the dispenser being adapted to create a first juice concentrate from a universal juice base and a first concentrated flavoring agent, and the dispenser being adapted to create a second juice concentrate from the universal juice base and a second concentrated flavoring agent.

4. The system of claim 2, wherein:

the diluent components comprise one or more of the following: water, milk, and yogurt; and the products comprise one or more of the following: juice, a juice-flavored milk, a juice-flavored smoothie, and a juice-flavored yogurt.

5. A dispensing system, comprising:

an input/output device adapted to receive a plurality of selections, the selections including one or more diluent selections and one or more diluent intensity selections; and a dispenser adapted to dispense one or more diluent components, the one or more diluent components corresponding at least in part to the one or more diluent selections, a ratio of the one or more diluent components corresponding at least in part to the one or more diluent intensity selections;

the input/output device comprises an input mechanism adapted to be adjusted along a continuous range of positions, wherein the continuous range of positions comprises:

a first discrete position indicating a first diluent option;

a second discrete position indicating a second diluent option, the first and second discrete positions are separated by a total distance; and an area between the first and second discrete positions, the area indicating a combination of the first and second diluent options;

the input/output device is adapted to receive each of the diluent selections when the input mechanism is adjusted to one location on the continuous range of positions; and the input/output device is further adapted to receive the diluent intensity selections when the input mechanism is adjusted to the location on the continuous range of positions, the location being a first distance from the first discrete position and a second distance from the second discrete position, a relative relationship between the first distance and the total distance indicating the relative amount of the first diluent selection and a relative relationship between the second distance and the total distance indicating a relative amount of the second diluent selection.

6. The system of claim 5, wherein:

the input/output device comprises a display that visually presents one or more diluent options and one or more pre-defined combinations of diluent options; and the input/output device is adapted to limit the one or more diluent selections to either one of the diluent options or one of the pre-defined combinations of diluent options.

7. The system of claim 5, wherein the input/output device comprises:

a display that visually presents a continuum of options to the user, the continuum visually illustrating a plurality of diluent options and a plurality of diluent intensity options; and an input mechanism adapted to select each of the one or more diluent selections and each of the one or more diluent intensity selections from the continuum of options.

8. A method for preparing a product, comprising:

presenting a plurality of options to the user, the options comprising a plurality of diluent options and a plurality of diluent intensity options;

receiving a plurality of selections from the user, the selections comprising one or more diluent selections and one or more diluent intensity selections;

determining one or more diluent components based at least in part on the diluent selections;

determining relative amounts of the diluent components based at least in part on the diluent intensity selections;

dispensing the product that includes the relative amounts of the diluent components; and wherein presenting a plurality of options to the user comprises presenting a continuum of options to the user, the continuum of options comprising a two-dimensional graph that visually illustrates the diluent options according to relative amount in the product.

9. The method of claim 8, wherein presenting a plurality of options to the user comprises presenting one or more pre-defined combinations of diluent options to the user.

10. The method of claim 8, further comprising limiting the one or more diluent selections to either one of the diluent options or one of a plurality of pre-defined combinations of diluent options.

11. The method of claim 8, wherein receiving a plurality of selections from the user comprises receiving an indication of a location of an input mechanism, the location being associated with each of the one or more diluent selections and each of the one or more diluent intensity selections.

12. The method of claim 8, wherein the continuum of options visually illustrates each diluent option using a diluent intensity line, the diluent intensity line having an amplitude that represents the diluent intensity options.

13. The method of claim 8, wherein:

an end point of the continuum is same as a beginning point of the continuum; and presenting a continuum of options to the user comprises presenting the continuum of options on a display, the end point of the continuum being positioned adjacent the beginning point of the continuum on the display such that the continuum of options appears endless.

14. The method of claim 8, wherein receiving a plurality of selections from the user comprises receiving an indication of a location on the continuum, the location on the continuum simultaneously indicating each of the one or more diluent selections and each of the one or more diluent intensity selections.

15. The method of claim 8, wherein:

the options further include one or more flavor options, and the selections further include one or more flavor selections, the product further includes one or more flavoring components, the flavoring components being determined at least in part by the flavor selections.

16. The method of claim 15, wherein:

the flavoring components comprise juice concentrates; and the diluent components comprise water, milk, and yogurt.

* * * * *